US008439558B2

(12) United States Patent
Pittet

(10) Patent No.: US 8,439,558 B2
(45) Date of Patent: May 14, 2013

(54) WINDING AND TIME-SETTING CONTROL DEVICE FOR A TIMEPIECE MOVEMENT

(75) Inventor: Jan Pittet, Le Lieu (CH)

(73) Assignee: Montres Breguet SA, l'Abbaye (CH)

( * ) Notice: Subject to any disclaimer, the term of this patent is extended or adjusted under 35 U.S.C. 154(b) by 190 days.

(21) Appl. No.: 13/042,868

(22) Filed: Mar. 8, 2011

(65) Prior Publication Data

US 2011/0216631 A1 Sep. 8, 2011

(30) Foreign Application Priority Data

Mar. 8, 2010 (EP) ..... 10155792

(51) Int. Cl.
*G04B 27/04* (2006.01)

(52) U.S. Cl.
USPC ..... 368/192; 368/319

(58) Field of Classification Search ..... 368/190, 368/192, 319
See application file for complete search history.

(56) References Cited

U.S. PATENT DOCUMENTS

| | | | | |
|---|---|---|---|---|
| 4,555,185 | A * | 11/1985 | Vuilleumier | 368/190 |
| 5,214,625 | A * | 5/1993 | Suzuki et al. | 368/192 |
| 6,939,034 | B2 | 9/2005 | Dubois | |
| 6,980,488 | B2 * | 12/2005 | Schneider | 368/37 |
| 7,563,020 | B2 | 7/2009 | Pittet | |
| 8,282,271 | B2 * | 10/2012 | Kressmann et al. | 368/319 |
| 2001/0046186 | A1 | 11/2001 | Dubois | |
| 2007/0025191 | A1 | 2/2007 | Pittet | |

FOREIGN PATENT DOCUMENTS

| | | | |
|---|---|---|---|
| DE | 19638714 | * | 3/1997 |
| EP | 1 134 628 | A1 | 9/2001 |
| EP | 1134628 | * | 9/2001 |
| EP | 1 560 082 | A2 | 8/2005 |
| EP | 1748330 | * | 1/2007 |

OTHER PUBLICATIONS

European search report issued in corresponding application 10155792, completed Aug. 30, 2010.
Pivot, Webster's Ninth New Collegiate Dictionary 897 (9th ed. 1990).

* cited by examiner

*Primary Examiner* — Sean Kayes
(74) *Attorney, Agent, or Firm* — Griffin & Szipl, P.C.

(57) ABSTRACT

A winding and time-setting control device for a timepiece movement including, connected in rotation, a movement stem secured in rotation to a sliding pinion driven in translation by a lever between winding and time-setting positions, and a control stem sliding between winding and time-setting control positions, actuating a pull-out mechanism. The mechanism includes a first pull-out piece including, about a first axis, an arm movable with the control stem, and a pivot cooperating with a complementary pivot of a second pull-out piece driving the lever and including an arm movable inside a housing in the movement stem. A timepiece incorporating a device of this type is also disclosed.

16 Claims, 5 Drawing Sheets

WINDING AND TIME-SETTING CONTROL DEVICE FOR A TIMEPIECE MOVEMENT

This application claims priority from European Patent Application No. 10155792.4 filed Mar. 8, 2010, the entire disclosure of which is incorporated herein by reference.

FIELD OF THE INVENTION

The invention concerns a winding and time-setting control device for a timepiece movement of the type including a movement stem that rotates about an axis in a movement plate and is secured in rotation to a sliding pinion. The pinion is axially movable under the action of a sliding pinion lever along said axis in translation between, on the one hand, a winding position in which said sliding pinion is arranged for cooperating with a winding mechanism to set the latter in rotation, and, on the other hand, a time-setting position in which said sliding pinion is arranged for cooperating with a time-setting mechanism to set the latter in rotation. Said device includes, connected in rotation to said movement stem by transmission means and shifted relative to said movement stem, a control stem rotating about a longitudinal axis and axially slidable at least between a winding control position and a time-setting control position and arranged for cooperating with a manual control crown. Said sliding pinion lever forms part of a pull-piece mechanism actuated by the sliding of said first stem between said winding position and said time-setting position. Said sliding pinion is meshed with said winding mechanism in said winding position when said control stem is in the winding control position, or with said time-setting mechanism when said control stem is in the time-setting control position.

The invention concerns the field of winding and time-setting mechanisms for timepiece movements.

STATE OF THE PRIOR ART

The use of two stems shifted in height in relation to each other and kinematically connected instead of the usual winding stem in a single piece or in two aligned pieces, may be advantageous in a mechanical timepiece with complications, when the complication elements have occupy space between the dial and the basic movement and thus mean that the movement is placed lower than the median plane of the timepiece case. The external crown of a usual winding stem would then be considerably closer to the back cover of the case than the bezel, which would be both inconvenient and unattractive. The two stem device holds the crown in its conventional and convenient place, at mid-height in the case.

In known devices of this type, for example those disclosed in CH Patent No. 691 632 in the name of Chopard International SA and in EP Patent No. 1 1 34 628 in the name of Dubois & Depraz SA, the two stems are connected in rotation by a transmission device and are also secured in translation, so that the second stem follows the first when the user pulls out the control crown. As a result, the second stem, namely the one which extends inside the movement, fulfils all the functions of a conventional stem and has to be fitted with the same members (pull-out piece, sliding pinion, winding pinion) as a conventional stem. Because of the place occupied by the gear connecting the two stems, the designer is forced to shift these members slightly towards the interior of the movement. Further, the connection for securing the two stems in translation requires a movable frame containing the gear and increasing the space required by the device. The axial play that inevitably exists in this frame leads to inaccuracies in the axial positions of the first stem, given that the axial position is generally indexed on the second stem.

The two stems of the winding and setting device disclosed in DE Patent No. 593 654 in the name of Wilhelm Koehler are also connected in rotation by a transmission device and secured in translation. The device disclosed in this latter document differs from the preceding ones in that it does not include either a sliding pinion or a pull-out mechanism. Switching to the time-setting position is achieved by pressing on the winding crown. According to this document, the second stem carries a crown wheel which meshes with the time-setting mechanism when the stems move in translation in reaction to pressure exerted by the user on the winding stem.

There is also known, from EP Patent No 1 560 082 in the name of Seiko Instruments Inc., a two-part winding stem that includes a first stem housed in the space between the middle part and the back cover receiving the movement and intended to cooperate with said movement. The second part, which is parallel to the first and cooperates at one end with the first stem, via a toothing comprised in each part, carries the crown at other end. The two stems are held together on a spacer including two bearings at the appropriate distance of centres, via an elastically mounted holding frame. The insertion in succession of the first stem, the spacer, the second stem and the frame is devised in a relatively limited volume, and dismantling is possible. However, the frame necessarily occupies a certain volume in the watch case. Moreover, pivotal guiding is restricted, and the suspended coupling by the frame is not favourable for the passage of high torque during winding. The axial play also leads to inaccuracy in the axial position of the stems.

A good solution to the problem of holding the winding and time-setting crown in the median plane of the timepiece case is known from EP Patent No. 1 748 330 in the name of MONTRES BREGUET SA. This Patent discloses a device with a first rotating stem that slides axially between a winding position and a time-setting position, secured to the timepiece crown, and a second stem parallel to and shifted relative to the first stem, and provided with means for selectively driving in rotation a winding mechanism and a time-setting mechanism. These two stems are secured in rotation by a transmission device. The second stem is secured in rotation to a sliding pinion, which is axially movable between two positions under the action of a lever. One end of this lever is engaged in a peripheral groove of the sliding pinion. The lever forms part of a pull-out mechanism actuated by the first stem sliding between the respective winding and time-setting positions, where the sliding pinion is meshed respectively with the winding mechanism and with the time-setting mechanism.

SUMMARY OF THE INVENTION

It is an object of the invention to create an improved device compared to the state of the art, in the sense that the device is much simpler and more compact, and is easy to integrate in an existing movement.

The invention therefore concerns a winding and time-setting control device for a timepiece movement of the type including a movement stem that rotates about an axis in a movement plate and is secured in rotation to a sliding pinion. The sliding pinion slides axially under the action of a sliding pinion lever along said axis in translation between, on the one hand, a winding position in which said sliding pinion is arranged for cooperating with a winding mechanism to set the latter in rotation, and, on the other hand, a time-setting position in which said sliding pinion is arranged for cooperating with a time-setting mechanism to set the latter in rotation.

Said device includes, connected in rotation to said movement stem by transmission means and shifted relative to said movement stem, a control stem rotating about a longitudinal axis and axially slidable at least between a winding control position and a time-setting control position and arranged for cooperating with a manual control crown. Said sliding pinion lever forms part of a pull-out mechanism actuated by said first stem sliding between said winding position and said time-setting position. Said sliding pinion is meshed with said winding mechanism in said winding position when said control stem is in the winding control position, or with said time-setting mechanism when said control stem is in the time-setting control position. The device is characterized in that said pull-out mechanism includes a first pull-out lever and including, on either side of a first pivoting axis, a first pull-out piece arm that moves in translation under the effect of a translation of said control stem, and a pivot, which cooperates, along a third pivoting axis, with a complementary pivot of a second pull-out lever and including, on either side of a second pivoting axis, on the one hand a second pull-out piece arm that moves in a housing in said movement stem, and on the other hand, said complementary pivot. Said second pull-out piece drives said sliding pinion lever so as to move said sliding pinion.

According to one feature of the invention, said second pivoting axis is aligned with said first pivoting axis, so as to ensure identical angular clearance for said first and second pull-out pieces during action on said control stem.

According to another feature of the invention, said longitudinal axis of said control stem is parallel to said axis of said movement stem, and said transmission means include an odd number of intermediate pinions higher than or equal to one, and the axis of at least one of said intermediate pinions is shifted relative to the plane formed by said longitudinal axis of said control stem and said axis of said movement stem.

The invention also concerns a timepiece including at least one timepiece movement of the type including a movement stem rotating about an axis in a movement plate and secured in rotation to a sliding pinion. The sliding pinion is axially movable under the action of a sliding pinion lever along said axis in translation between, on the one hand, a winding position in which said sliding pinion is arranged for cooperating with a winding mechanism to set the latter in rotation, and on the other hand, a time-setting position in which said sliding pinion is arranged for cooperating with a time-setting mechanism to set the latter in rotation. The timepiece also includes at least one device of this type.

Thus, the switching between winding and time-setting via the axial movement of the first stem is carried out on the second stem by means of an improved pull-out mechanism, which is compact and particularly rigid, which avoids the aforementioned drawbacks of a frame that moves in translation. The pull-out device has the advantage of being proven and low in height. The position of the shifted intermediate pinion permits any desired distance of centres value between the control stem and the movement stem.

It is particularly easy to adapt the device to existing movements.

According to a preferred embodiment of the invention, the second stem does not slide and includes a section of non-circular transverse section, for example square section, on which the sliding pinion is slidably engaged, said pinion having a peripheral groove in which one end of a lever of the pull-out mechanism engages. This results in a very compact construction with simplified bearings.

DESCRIPTION OF THE DRAWINGS

Other features and advantages of this invention will appear from the following description, which presents a preferred embodiment by way of non-limiting example with reference to the annexed drawings, in which.

DETAILED DESCRIPTION OF THE INVENTION

Figure 1:
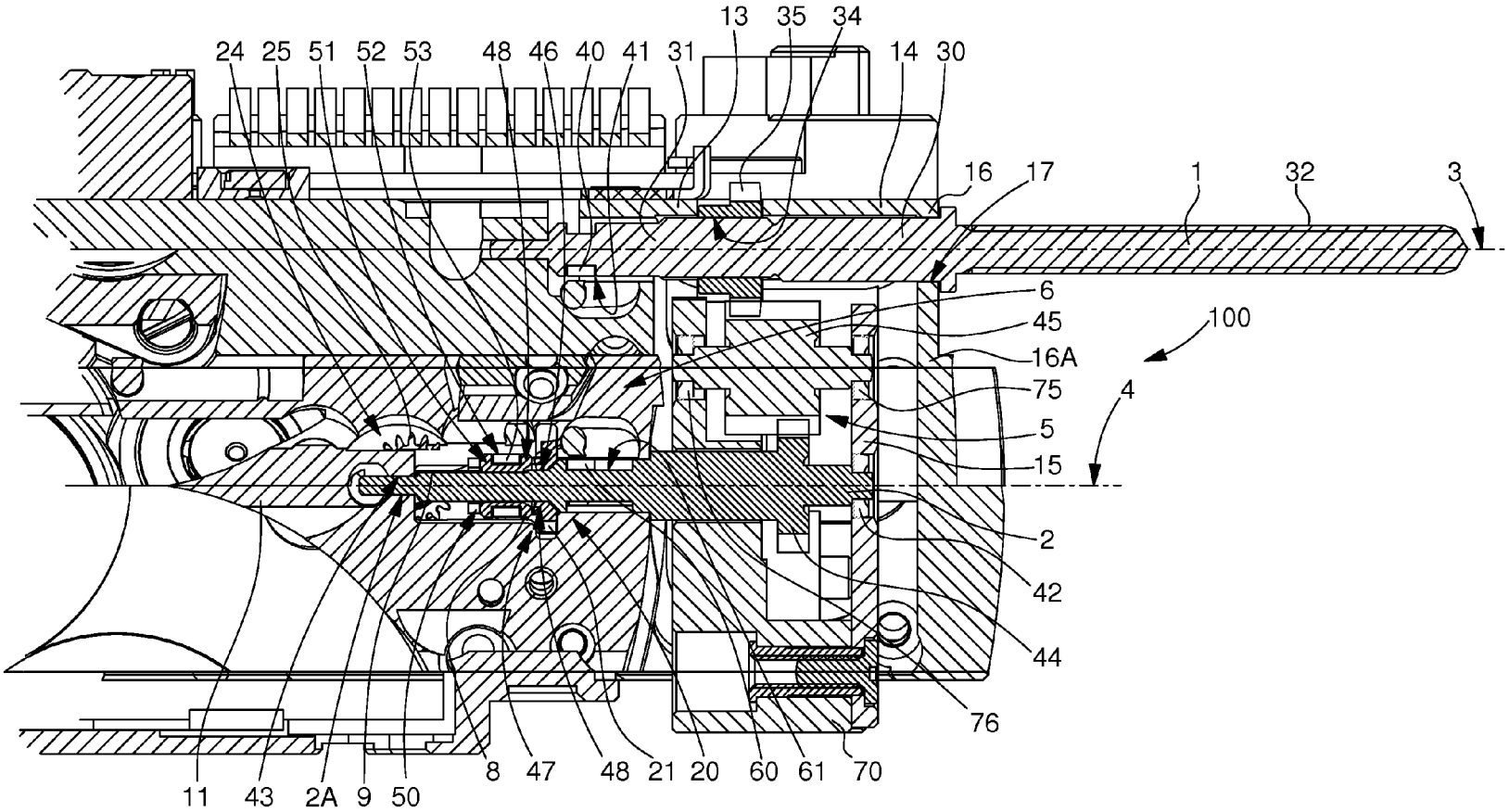
FIG. 1 is a schematic view, in longitudinal section, along a broken line passing through the axes of a control stem, an intermediate pinion and a movement stem, comprised in a device according to the invention, when the latter is in the winding control position.

The invention concerns the field of winding and time-setting mechanisms for timepiece movements.

The invention concerns a winding and time-setting control device 100 for a timepiece movement.

The device shown in the drawings includes two winding and time-setting stems, namely a control stem 1 and a movement stem 2, whose respective axes of rotation 3 and 4 are parallel, but shifted in height in relation to each other, in a perpendicular or oblique direction relative to the general plane of the timepiece movement. These stems 1 and 2 are connected by two kinematic links, namely a gear transmission 5, which is permanently meshed and transmits the rotation from one stem to another, and a pull-out mechanism 6, which transmits axial movements from first stem 1 to a sliding pinion 8. The entire device is supported, from a movement plate 1 of the timepiece, by fixed elements or bridges. A winding mechanism 20, whose winding pinion 21 can be seen in the drawings, and a time-setting mechanism 24, whose motion work intermediate wheel 25 can be seen in the drawings, are also mounted on these fixed elements.

The timepiece movement referred to here is of a conventional type, including a movement stem 2 rotating about a longitudinal axis 4, and guided at least on one shoulder 2A in a movement plate 11. Movement stem 2 is secured in rotation to a sliding pinion 8, which is axially movable, under the action of a sliding pinion lever 52, along axis 4. This sliding pinion 8 moves in translation between, on the one hand, a winding position in which it is arranged for cooperating with a winding mechanism 20 to set the latter in rotation, and, on the other hand, a time-setting position in which sliding pinion 8 is arranged for cooperating with a time-setting mechanism 24, to set the latter in rotation. Sliding pinion 8 is slidably mounted on a square section 9 of movement stem 2, to which it is secured in rotation via the central square orifice thereof. In the embodiment shown in the Figures, movement stem 2 does not slide, i.e. the axial position thereof is fixed. The two ends of movement stem 2 are preferably provided with cylindrical pivots. A bearing or jewel 42 mounted in a flange 15 and a bore 43 in movement plate 11 form rotation bearings which support stem 2 and hold it axially. A pinion 44 is fixed to the stem and meshes permanently on an intermediate pinion 45, thus forming the last pinion of the gear transmission.

The movement stem 2 includes an edge, in the form of a straight or conical shoulder, on which a winding pinion 21 can abut, said winding pinion being freely mounted on a cylindrical shoulder 46 of movement stem 2. Pinion 21 is of conventional design, preferably including a Breguet type contrate toothing 47, capable of cooperating with a corresponding contrate toothing 48 of sliding pinion 8 when the latter is in the winding position, and a straight toothing 49 permanently meshed with an intermediate wheel (not shown in the Figures). The other end of sliding pinion 8 is provided with a contrate toothing 50 devised to mesh with motion work intermediate wheel 25, when the sliding pinion 8 is in the time-setting position. The sliding pinion 8 also has a peripheral groove 51 in which a sliding pinion lever 52 is engaged.

Figure 2:
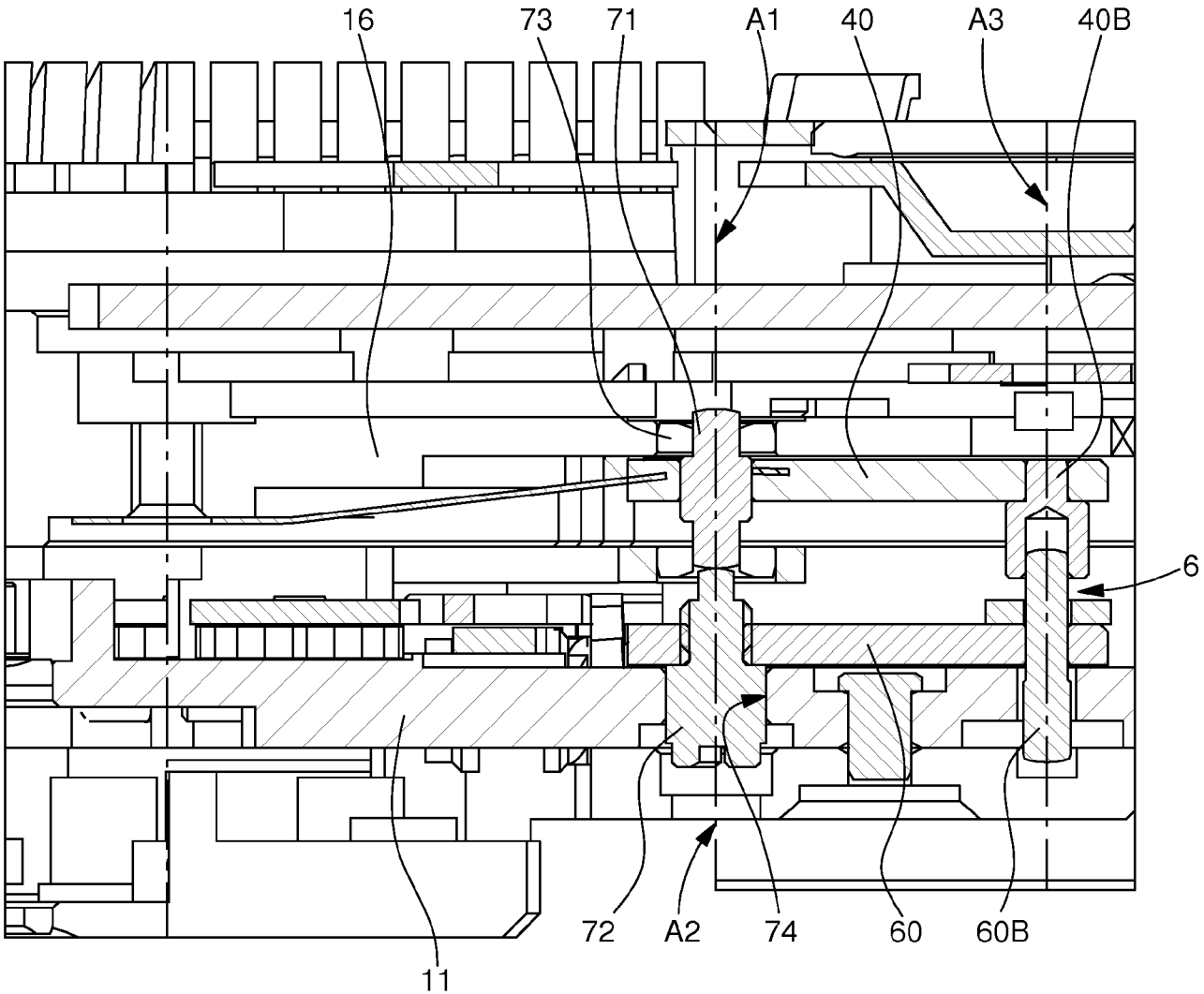
FIG. 2 is a partial schematic view in substantially orthogonal transverse section to the section of FIG. 1, passing through a first pivoting axis and a second pivoting axis respectively of a first pull-out piece and a second pull-out piece comprised in said device, and through a third pivoting axis of articulation between said first pull-out piece and said second pull-out piece.

Device 100 includes a control stem 1, connected in rotation to movement stem 2 by transmission means 5, and shifted relative to movement stem 2, i.e. not aligned therewith. This control stem 1 rotates about a longitudinal axis 3 and slides axially at least between a winding control position and a time-setting control position. Preferably, control stem 1 is arranged for cooperating with a manual control crown, not shown in the Figures. Preferably, the axis 3 of control stem 1 is parallel to the axis 4 of movement stem 2, as shown in FIGS. 1 and 2. Control stem 1 preferably includes a first cylindrical part 30 and a second cylindrical part 31, whose diameter is smaller than the first part. These parts are slidably mounted in bores in the fixed elements 14, 13 of a plate 16 acting as bearings, so that control stem 1 can slide between the winding position and the time-setting position. In other embodiments, a third position could be provided for stem 1, for example for setting the date. Like a conventional winding stem, stem 1 has a threaded end 32 that will pass through the middle part of the timepiece case and carry a manual control stem on the outside of the case.

A square section part 34 of stem 1 is engaged in an orifice of corresponding section in a first pinion 35, which is retained axially between fixed elements 13 and 14. The central orifice of pinion 35 may also include a circular section portion that fits onto a cylindrical part of element 13, said part serving as a bearing to support pinion 35 radially when stem 1 is removed, for example to case up the movement. In cylindrical part 30 of stem 1, there is an annular groove 41 in which a stud or arm 40A of a first pull-out piece 40 is engaged. The latter can be lowered to release the stud from the groove when a watchmaker wishes to remove stem 1.

The sliding pinion lever 52 forms part of a pull-out mechanism 6, which is actuated by sliding the first stem 1 between the winding control position and the time-setting control position. Sliding pinion 8 is meshed with winding mechanism 20 in the winding position when control stem 1 is in the winding control position. Or sliding pinion 8 is meshed with time-setting mechanism 24 when control stem 1 is in the time-setting control position.

According to the invention, pull-out mechanism 6 includes a first pull-out piece 40, cooperating with control stem 1. This first pull-out piece 40 forms a lever and includes, on either side of a first pivoting axis A1, on the one hand, a first pull-out piece arm 40A that moves in translation under the effect of a translation of control stem 1, and, on the other hand, a pivot 40B. This pivot 40B cooperates, along a third pivoting axis A3, with a complementary pivot 60B, comprised in a second pull-out piece 60. Like first pull-out piece 40, this second pull-out piece 60 forms a lever, and includes, on either side of a second pivoting axis A2, on the one hand, an arm of second pull-out piece 60A that is movable, notably in translation, inside a housing 61 comprised in movement stem 2, and on the other hand, complementary pivot 60B. The second pull-out piece 60 drives the sliding pinion lever 52 to move sliding pinion 8.

Naturally, the pull-out mechanism, described here in a simple and advantageous embodiment with two pull-out pieces, may include more pull-out pieces, cooperating with each other in the same pivoting manner, without departing from the spirit of the invention.

Preferably, as seen in FIG. 2, the first pull-out piece arm 40A is engaged in a first groove 41 comprised in first stem 1. The width of first groove 41 just allows arm 40A to pivot. A longitudinal movement of control stem 1 is thus transmitted with minimum play onto the link mechanism formed of first pull-out piece 40 and second pull-out piece 60.

The second pull-out piece arm 60A is preferably engaged in a second groove 61 comprised in movement stem 2. Preferably movement stem 2 is fixed in translation, and consequently the width of groove 61 is larger than that of the second pull-out piece arm 60*a*, so as to allow the latter complete clearance.

The sliding pinion lever 52 includes an arm secured in translation to sliding pinion 8, preferably via cooperation with a groove 51 therein, in which it is engaged, with minimum operational play in a similar manner to the cooperation between first pull-out piece arm 40A and first groove 41.

Preferably, as seen in FIGS. 2 to 5, the second pivoting axis A2 is parallel to said first pivoting axis A1. And, advantageously, the second pivoting axis A2 is aligned with first pivoting axis A1, so as to ensure identical angular clearance for first pull-out piece 40 and second pull-out piece 60 during action on control stem 1.

Figure 3:
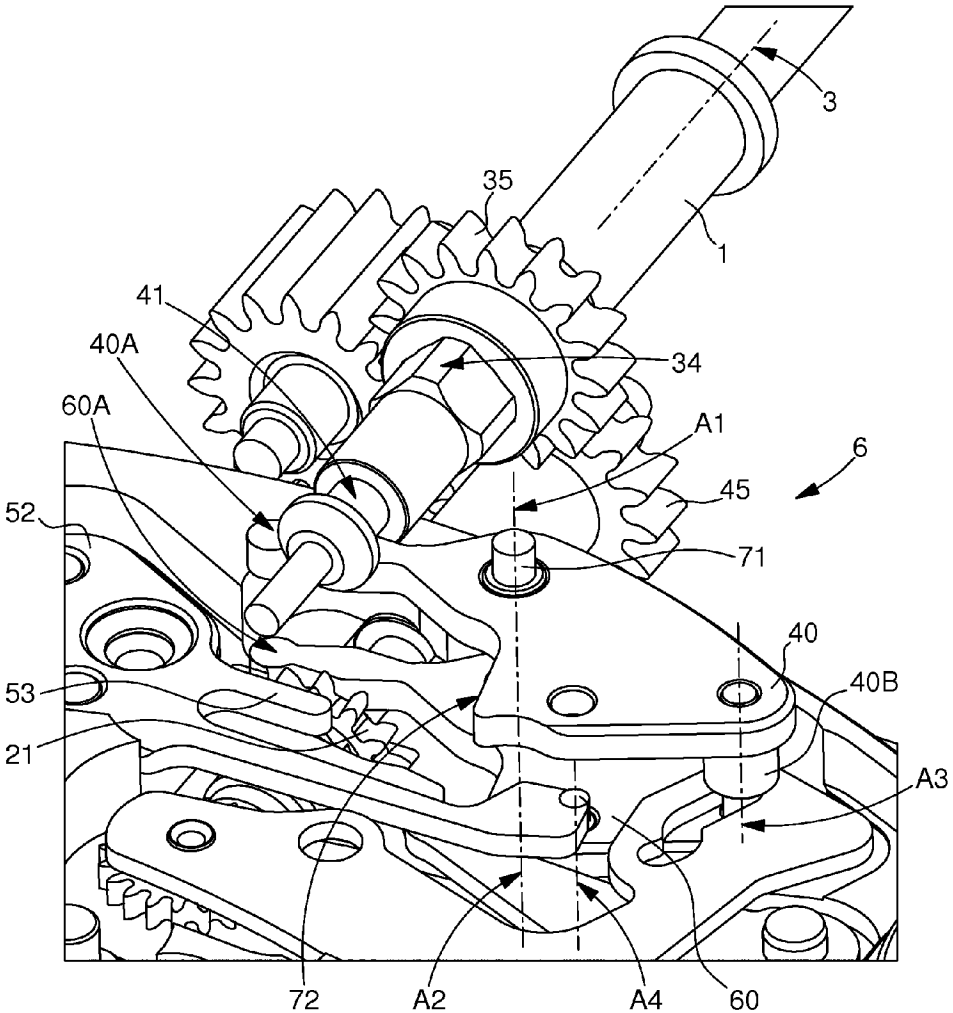
FIG. 3 is a partial schematic and perspective view of the device of FIG. 1 or 2, showing how the first pull-out piece is controlled by the control stem, the link between the first pull-out piece and the second pull-out piece, and the link between the latter and a lever controlling the position of a sliding pinion.
Figure 4:
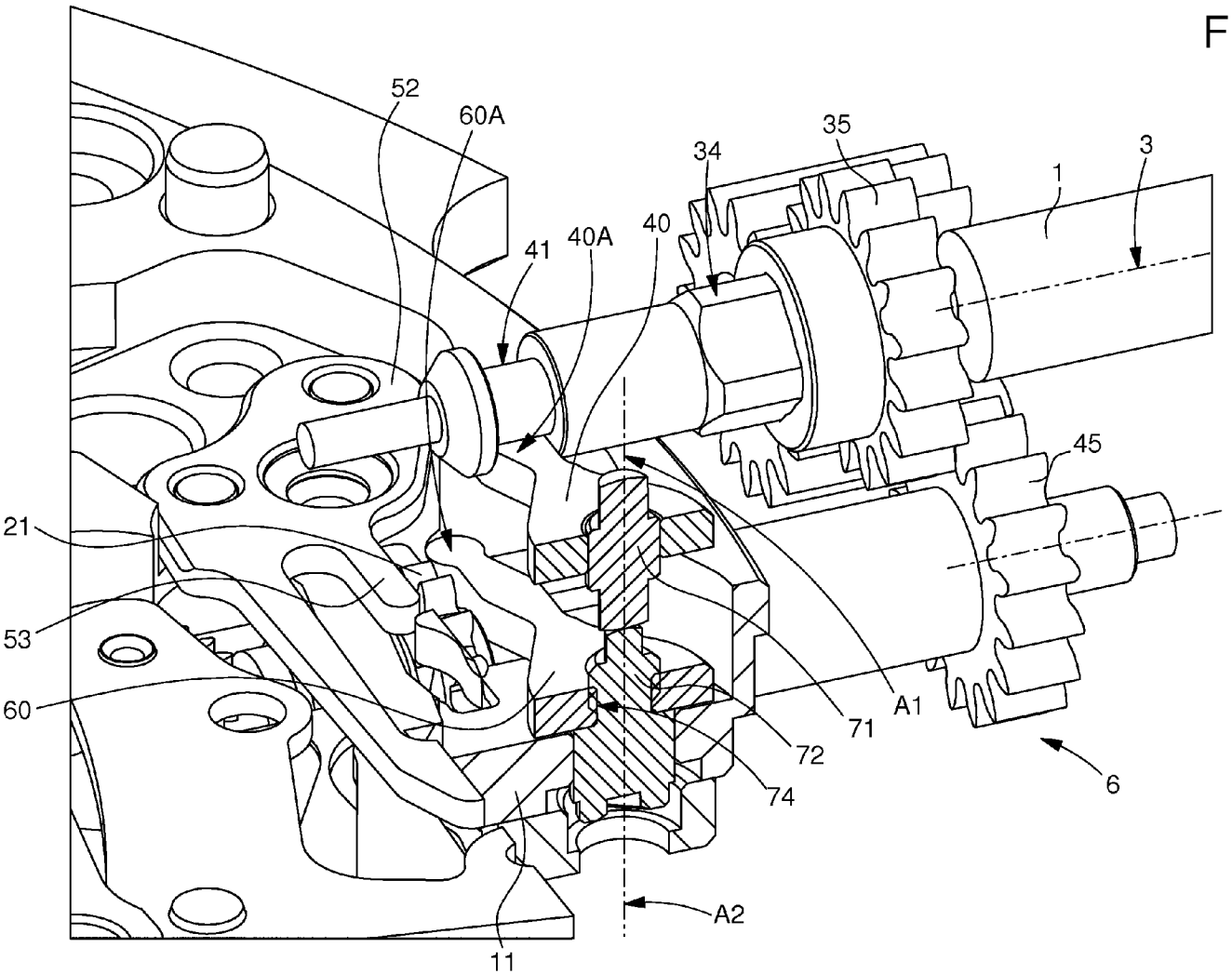
FIG. 4 is a similar view to FIG. 3, taken on the first pivoting axis and the second pivoting axis respectively of the first pull-out piece and the second pull-out piece.
Figure 5:
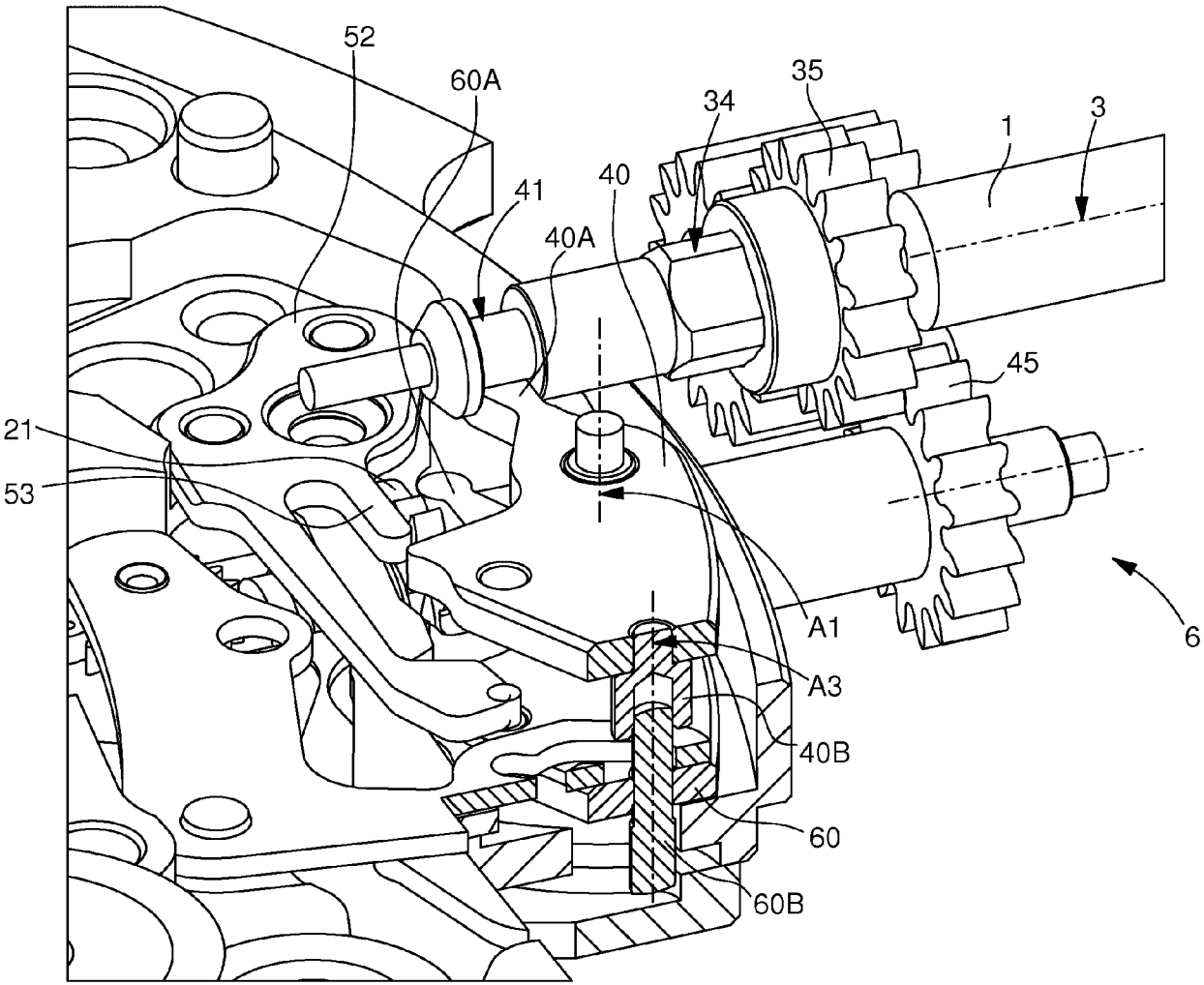
FIG. 5 is a similar view to FIG. 3, taken on the third pivoting axis of articulation between the first pull-out piece and the second pull-out piece.

It is clear that second pull-out piece 60, which is located at the level of the movement, or integrated therein, is used for actuating sliding pinion lever 52, by identically reproducing the off-centre movement imparted to first pull-out piece 40 by control stem 1. In a particular embodiment, as seen in FIG. 3, the second pull-out piece 60 includes a jointed connection with sliding pinion lever 52 via a connector pivoting about pivoting axis A4.

As regards transmission means 5, the means preferably include an odd number of intermediate pinions 45, so that movement stem 2 is driven in the same direction of rotation as control stem 1. This number of pinions 45 is higher than or equal to 1. Advantageously for an economical embodiment, the axis of each of intermediate pinions 45 is parallel to axis 4 of movement stem 2.

Preferably, the axis of at least one of these intermediate pinions 45 is shifted relative to the plane formed by longitudinal axis 3 of control stem 1 and by axis 4 of movement stem 2, when these two axes are coplanar and preferably parallel. This shifted position of intermediate pinion 45 enables device 100 to be adapted to any desired distance of centres value between control stem 1 and movement stem 2.

Preferably, as seen in FIGS. 1 and 2, device 100 includes an additional plate 16 arranged to be secured to movement plate 11, and which includes means 17 for guiding control stem 1 in rotation.

Device 100 further includes a box 70, which is arranged to be secured to additional plate 16 and contain transmission means 5, in cooperation with a locking flange 15 arranged for closing said box 70 and to form pivoting guide means for transmission means 5. As seen in FIG. 1, this pivoting guide means can, in particular, form a bearing 75 arranged on flange 15 and a bearing 76 on box 70. Naturally, if transmission means 5 also includes several intermediate pinions of the pinion 45 type, the same number of similar bearings is arranged on box 70 and on locking flange 15.

Advantageously, as seen in FIG. 2, additional plate 16 includes at least one bearing 73 arranged for receiving a pivot 71 comprised in first pull-out piece 40, and which forms the first pivoting axis A1.

Opposite bearing 73, movement plate 11 includes at least one bearing 74 for receiving a pivot 72 comprised in second pull-out piece 60 and which forms the second pivoting axis A2.

The invention also concerns a timepiece including at least one timepiece movement of the type described above including a movement stem 2 rotating about an axis 4 in a movement plate 11 and secured in rotation to a sliding pinion 8. This sliding pinion 8 moves axially under the action of a sliding pinion lever 52 along said axis 4 in translation between, on the one hand, a winding position in which sliding pinion 8 is arranged so as to cooperate with a winding mechanism 20 to set the latter in rotation, and on the other hand, a time-setting position in which sliding pinion 8 is arranged so as to cooperate with a time-setting mechanism 24 to set the latter in rotation. According to the invention, this timepiece includes at least one device 100 associated with one of these movements.

Preferably, movement stem 2 of this timepiece is fixed in translation. According to a variant that is not shown, movement stem 2 could be slidable and secured to sliding pinion 8. Pinion 44 would then have to be longer in order to stay meshed with intermediate pinion 45 during said sliding. Further, winding pinion 31 would have to be held axially so as not to slide with movement stem 2, i.e. the length of the construction would be a little longer than that shown in FIG. 1.

What is claimed is:

1. A winding and time-setting control device for a timepiece movement, wherein the timepiece movement includes (i) a movement stem that rotates about an axis in a movement plate;

(ii) a sliding pinion, wherein the movement stem is secured in rotation to the sliding pinion; and (iii) a sliding pinion lever, wherein the sliding pinion is axially movable via an action of the sliding pinion lever along the axis in the movement plate, wherein the sliding pinion lever is movable between a winding position and a time-setting position, wherein while in the winding position, the sliding pinion is arranged so as to cooperate with a winding mechanism to set the winding mechanism in rotation, wherein while in the time-setting position, the sliding pinion is arranged so as to cooperate with a time-setting mechanism to set the time-setting mechanism in rotation, the winding and time-setting control device comprising:

(a) a control stem, wherein the control stem is connected in rotation to the movement stem by a transmission means and shifted relative to the movement stem, wherein the control stem rotates about a longitudinal axis and is axially slidable at least between a winding control position and a time-setting control position;

(b) a manual control crown, wherein the control stem is arranged for cooperating with the manual control crown; and (c) a first pull-out mechanism, wherein the sliding pinion lever is part of the first pull-out mechanism, and wherein the first pull-out mechanism is actuated by sliding the control stem between the winding control position and the time-setting control position, wherein the sliding pinion meshes with the winding mechanism in the winding position when the control stem is in the winding control position, or with the time-setting mechanism when the control stem is in the time-setting control position, wherein the first pull-out mechanism includes (i) a first lever, wherein the first lever is formed by a first pull-out piece that has a first pull-out piece arm and a first pivot;

(ii) a first pivoting axis, wherein the first pivoting axis has a first side and a second side, and wherein the first pull-out piece arm moves in translation via the effect of a translation of the control stem, and wherein the first pull-out piece arm moves either on the first side of the second side of the first pivoting axis;

(iii) a second lever, wherein the second lever is formed by a second pull-out piece that has a second pull-out piece arm and a second pivot, wherein the second pull-out arm is movable inside a housing that includes the movement stem, and wherein the second pull-out piece drives the sliding pinion lever to move the sliding pinion;

(iv) a second pivoting axis; and (v) a third pivoting axis, wherein the first pivot cooperates, along the third pivoting axis, with the second pivot.

2. The device according to claim 1, wherein the first pull-out piece arm is engaged in a first groove comprised in a first stem.

3. The device according to claim 1, wherein the second pull-out piece arm is engaged in a second groove comprised in the movement stem, and wherein the width of the second groove is larger than that of said second pull-out piece arm.

4. The device according to claim 1, wherein the sliding pinion lever includes an arm secured in translation to the sliding pinion and engaged in a groove therein.

5. The device according to claim 1, wherein the second pivoting axis is parallel to the first pivoting axis.

6. The device according to claim 1, wherein the second pivoting axis is parallel to the first pivoting axis, and wherein the second pivoting axis is aligned with the first pivoting axis so as to ensure identical angular clearance for the first pull-out piece and the second pull-out piece, during action on the control stem.

7. The device according to claim 1, wherein the longitudinal axis of the control stem is parallel to the axis of the movement stem.

8. The device according to claim 7, wherein the axis of at least one of the intermediate pinions is shifted relative to the plane formed by the longitudinal axis of the control stem and the axis of the movement stem.

9. The device according to claim 1, wherein the second pull-out piece includes a jointed connection with the sliding pinion lever via a pivoted connection about a pivoting axis.

10. The device according to claim 1, wherein the transmission means includes an odd number of intermediate pinions higher than or equal to one.

11. The device according to claim 1, wherein the transmission means includes an odd number of intermediate pinions higher than or equal to one, and wherein the axis of each of the intermediate pinions is parallel to the axis of the movement stem.

12. The device according to claim 11, wherein the axis of at least one of the intermediate pinions is shifted relative to the plane formed by the longitudinal axis of the control stem and the axis of the movement stem.

13. The device according to claim 1, wherein it includes an additional plate arranged to be secured to the movement plate and including means for guiding the control stem in rotation, a box arranged to be secured to the additional plate and to contain the transmission means in cooperation with a flange arranged for closing the box and forming pivoting guide means for the transmission means.

14. The device according to claim 13, wherein the additional plate includes at least one bearing for receiving a pivot comprised in the first pull-out piece and which forms the first pivoting axis, and wherein the movement plate includes at least one bearing for receiving a pivot comprised in the second pull-out piece and which forms the second pivoting axis.

15. A timepiece including at least one timepiece movement, the timepiece comprising:

(a) at least one timepiece movement including (i) a movement stem that rotates about an axis in a movement plate;

(ii) a sliding pinion, wherein the movement stem and is secured in rotation to a sliding pinion; and (iii) a sliding pinion lever, wherein the sliding pinion moves axially via an action of the sliding pinion lever along the axis in translation between a winding position and a time-setting position, wherein while in the winding position, the sliding pinion is arranged so as to cooperate with a winding mechanism to set the winding mechanism in rotation, wherein while in the time-setting position, the sliding pinion is arranged so as to cooperate with a time-setting mechanism to set the time-setting mechanism in rotation; and (b) at least one device according to claim 1, wherein the device is associated with one of said at least one timepiece movements.

16. The timepiece according to claim 15, wherein the movement stem is fixed in translation.

* * * * *